US009205945B2

(12) United States Patent
Flynn et al.

(10) Patent No.: US 9,205,945 B2
(45) Date of Patent: Dec. 8, 2015

(54) APPARATUS AND METHOD FOR APPLYING A LABEL TO AN OBJECT

(75) Inventors: Timothy J. Flynn, Key Largo, FL (US); Geoffrey T. Brossard, Crystal Lake, IL (US)

(73) Assignee: Timothy J. Flynn, Key Largo, FL (US)

( * ) Notice: Subject to any disclaimer, the term of this patent is extended or adjusted under 35 U.S.C. 154(b) by 996 days.

(21) Appl. No.: 13/007,088

(22) Filed: Jan. 14, 2011

(65) Prior Publication Data

US 2011/0180204 A1 Jul. 28, 2011

Related U.S. Application Data

(60) Provisional application No. 61/295,480, filed on Jan. 15, 2010, provisional application No. 61/299,233, filed on Jan. 28, 2010.

(51) Int. Cl.
*B65C 9/26* (2006.01)
*B65C 9/00* (2006.01)

(52) U.S. Cl.
CPC .. *B65C 9/262* (2013.01); *B65C 9/00* (2013.01)

(58) Field of Classification Search
CPC ..... B43L 13/04; B43L 13/041; B43L 13/045; G09B 21/002; B65C 9/00; B65C 9/20; B65C 9/26; B65C 3/00
USPC ..... 156/230, 247, 349
IPC ..... B65C 9/26, 9/20, 9/00, 3/00
See application file for complete search history.

(56) References Cited

U.S. PATENT DOCUMENTS

| | | | | | |
|---|---|---|---|---|---|
| 3,215,582 | A | * | 11/1965 | Carter | 156/564 |
| 3,950,853 | A | * | 4/1976 | Andrew | 33/438 |
| 4,366,626 | A | * | 1/1983 | Livick | 33/435 |
| 4,369,582 | A | * | 1/1983 | Pfeffer | 33/613 |
| 4,513,511 | A | * | 4/1985 | Dowzall et al. | 33/447 |
| 4,539,759 | A | * | 9/1985 | Dowzall et al. | 33/615 |
| 4,936,176 | A | * | 6/1990 | Silverman | 83/468 |
| 6,660,113 | B2 | * | 12/2003 | Hummell et al. | 156/60 |
| 6,776,208 | B1 | | 8/2004 | Flynn et al. | |
| 6,776,866 | B2 | | 8/2004 | Flynn et al. | |
| 6,776,867 | B2 | | 8/2004 | Flynn et al. | |
| 6,799,621 | B2 | | 10/2004 | Flynn et al. | |
| 6,805,180 | B2 | | 10/2004 | Flynn et al. | |
| 6,881,461 | B2 | | 4/2005 | Flynn et al. | |
| 6,932,133 | B1 | | 8/2005 | Flynn et al. | |
| 7,001,476 | B2 | | 2/2006 | Flynn et al. | |
| 7,033,456 | B2 | | 4/2006 | Flynn et al. | |
| 7,124,796 | B2 | | 10/2006 | Flynn et al. | |

* cited by examiner

*Primary Examiner* — Mark A Osele
(74) *Attorney, Agent, or Firm* — Pauley Erickson & Kottis

(57) ABSTRACT

Apparatus and method for applying a label to an object. The apparatus includes a label assembly retaining device, a first object alignment element, and a second object alignment element movable with respect to the first object alignment element. The object alignment elements are movable to size the apparatus to the object, and desirably to form a chute through which the object can be lowered or dropped onto exposed adhesive of the label below.

21 Claims, 19 Drawing Sheets

APPARATUS AND METHOD FOR APPLYING A LABEL TO AN OBJECT

CROSS REFERENCE TO RELATED APPLICATIONS

This application claims the benefit of U.S. Provisional Patent Application, Ser. No. 61/295,480, filed on 15 Jan. 2010, and U.S. Provisional Patent Application, Ser. No. 61/299,233, filed on 28 Jan. 2010. The co-pending Provisional Patent Applications are hereby incorporated by reference herein in their entireties and are made a part hereof, including but not limited to those portions which specifically appear hereinafter.

BACKGROUND OF THE INVENTION

This invention relates generally to an apparatus and method for the positive, indexed application of labels to objects such as electronic music players and smartphones.

Labels such as those described herein can be used in connection with a wide variety of items, particularly, media such as compact discs (CDs), jewel cases, flash drives and the like, and personal electronic devices such as electronic music players, cell phones and smartphones. It is common to label such objects for identification purposes and/or decorative purposes. It is desirable to have a label for adhering to items that will apply straight and direct to the object without misalignment, wrinkles, bubbles, folds or other errors inherent in the application of adhesive-backed labels to items. Objects having curved surfaces, view screens and control elements that are not to be covered, and/or small edge areas to which the label is adhered, such as music players or smartphones, exacerbate the problem of applying a label in an aesthetically pleasing aligned position on an object.

Accordingly, a continued need exists for a new and improved means for labeling the objects in an accurate and positive fashion.

SUMMARY OF THE INVENTION

The present invention relates to an applicator apparatus for use with a label assembly for applying a label to an object. The label assembly is of any suitable shape, and generally any suitable size that can be accepted by and fed through a printer, such as a laser printer or an ink jet printer. The label assembly preferably includes a face sheet and a back sheet with a layer of adhesive in-between. The adhesive is preferably applied to one side of the face sheet with an opposite side of the face sheet having a printable surface.

The label assembly for use in this invention further includes the face sheet having a label portion removable with respect to a carrier portion. The label portion is preferably pre-cut or shaped into a desired form for application in a desired manner, such as a skin for, without limitation, a recordable medium, laptop, tablet device, smartphone, IPOD® music player, cellular phone, or mp3 music player. The back sheet of the label assembly preferably includes a first portion that is removable with respect to a second portion (or the entire back sheet can be removed) to expose at least a portion of the adhesive on the back of the label to be applied. The back sheet preferably includes one side having a treated surface to facilitate removal of the back sheet relative to the face sheet. Therefore, at least one side of the back sheet preferably includes a smooth and/or waxy surface to ease separation from the adhesive side of the face sheet. The side opposite the treated surface of the back sheet may be a printable surface or any other suitable surface.

The first portion of the back sheet is preferably generally coextensive with the label portion of the face sheet. Likewise, a second portion of the back sheet is preferably generally coextensive with a second portion of the label or the carrier portion of the face sheet. When the first portion is removed from the label assembly, the second portion of the back sheet is attached to, and can support, the label portion of the face sheet. In one embodiment of this invention, a label portion corresponding to the object to be labeled is retained following removal of a back sheet first portion.

The apparatus of this invention allows the object to be labeled to be lowered or dropped onto the label assembly in an aligned manner with the label. The apparatus can form a chute for the aligned dropping and/or can include an object support that when removed causes the object to fall onto the label. The apparatus can include an adjustable chute, such as formed by moving alignment elements, to accommodate objects (and labels) of different sizes.

The apparatus of this invention for applying a label to an object can include a label assembly retaining device, a first object alignment element, and a second object alignment element movable with respect to the first object alignment element. The alignment elements desirably form a chute into which the object is dropped or otherwise lowered in aligned position onto the exposed adhesive, similar to the drop method in U.S. Pat. No. 6,932,133, herein incorporated by reference. The object guidance element can be adjustable to size the chute for different size objects.

The label assembly retaining device retains a label assembly beneath the first object alignment element and the second object alignment element. The label assembly retaining device can include pins corresponding to openings in at least one layer of the label assembly, such as for aligning and/or holding the label assembly.

The apparatus of this invention can include a base, and the label assembly retaining device can be formed at least in part including a side wall surface of the base against which the label assembly is positioned. The first object alignment element can be part of or connected to the base. The first object alignment element can be movable over the base.

The first object alignment element can include a groove, and the second object alignment element can include a slide that is disposed and movable within the groove. The apparatus of this invention can also include more than one first object alignment element and more than one second object alignment element, where each of the first object alignment elements includes a groove and each of the second alignment elements includes a slide disposed and movable within the groove of one of the first object alignment elements. The apparatus of this invention can further include more than one first object alignment element and more than one second object alignment element, where each of the first object alignment elements and each of the second object alignment elements comprises a groove, and each of the first object alignment elements and each of the second object alignment elements comprises a slide disposed and movable within the groove of an adjacent object alignment element.

The apparatus of this invention for applying a label to an object can include a label assembly retaining device, a pair of first object alignment elements, and a pair of second object alignment elements connected to and laterally movable with respect to the first object alignment elements.

The apparatus of this invention for applying a label to an object can include a base defining a label application surface for receiving the label and/or label assembly, and the second object alignment element can be embodied as an object support or guidance element that is spaced apart from and at least partially movable over at least a portion of the label application surface.

The apparatus can include an object support element including an object support surface extending above and/or substantially parallel with the label application surface. The apparatus can include a channel groove and a fixed or movable slide disposed within the channel groove, wherein one of the base and the object support element includes the channel groove and an other of the base and the object support element includes the slide.

The apparatus can include a raised edge along at least one side of the base and the label application surface. The apparatus can include the label application surface extending downward at an angle along or away from a raised edge.

The apparatus can include also a recess extending between a portion of the raised edge and the base, wherein the recess extends the label application surface beneath the portion of the raised edge. The apparatus can include a slit groove as an opening extending through the raised edge, wherein the object support element is disposed within the slit groove and movable therethrough. The apparatus can include a slide disposed within the slit groove, and a channel groove extending through the object support element, wherein the slide is disposed within the channel groove.

The apparatus can include the object support element formed as one or more arms connected to the raised edge and extending across from the label application surface, the arm(s) being laterally moveable over the label application surface. The apparatus can further include a slit groove extending in a top side of the raised edge and a slide disposed and moveable within the slit groove. The apparatus can include a second arm connected to at least one of the first arm or the base at a second edge and extending across and spaced apart from the label application surface.

The apparatus for applying a label to an object can also include a base defining a label application surface, a raised edge extending along a first side and a second side of the base and the label application surface, a slit groove extending through the raised edge at a spaced distance from the label application surface, and an object support element laterally movable within the slit groove over the label application surface.

The apparatus can also include an object support element that includes a first arm connected to the raised edge along the first side and extending across and spaced apart from the label application surface, a second arm connected to at least one of the first arm or the raised edge along the second side and extending across and spaced apart from the label application surface, and each of the first arm and the second arm being laterally moveable over the label application surface into contact with an object to be labeled using the apparatus.

The invention further includes a method of applying a label to an object, comprising removing at least a portion of a back sheet from a label assembly to expose an adhesive material on at least a portion of a label of the label assembly, framing the exposed adhesive with alignment elements of an apparatus that are disposed above the label assembly, and lowering, e.g., dropping or pushing, at least a portion of the object onto the exposed adhesive material.

The method can include placing the label assembly on a surface of a labeling apparatus with the exposed adhesive material facing away from the surface, placing the object on an object support element disposed over and spaced apart from the exposed adhesive material, and lowering at least a portion of the object onto the exposed adhesive material.

The method can include placing the label assembly on a label application surface of a labeling apparatus with the exposed adhesive material facing away from the label application surface, placing the object on an object support element disposed over and spaced apart from the exposed adhesive material, and moving the object support object from beneath the object to drop at least a portion of the object onto the exposed adhesive material.

The method can include printing on a surface of the label that is opposite the back sheet before removing the at least a portion of the back sheet.

The method can include placing the label assembly against a raised edge of the labeling apparatus that extends around two sides of the label application surface.

Other objects and advantages will be apparent to those skilled in the art from the following description taken in conjunction with the appended drawings.

DESCRIPTION OF THE DRAWINGS

The present invention provides an applicator apparatus for use with a label assembly for applying a label to an object. FIGS. 1-6 illustrate a label application device 20 for applying a label to an object, such as, without limitation, smartphones, electronic or mp3 players, laptops, tablet device, book readers, DVDs, flash drives, and/or cases therefor, according to one embodiment of this invention. The device 20 includes a base 22 and two first object alignment elements 24 and 26 connected to the base 22. At least one of the two first object alignment elements 24 and 26 is independently movable over the base 22 to place the first object elements 24 and 26 in the desired position over a label assembly placed thereunder.

Figure 1:
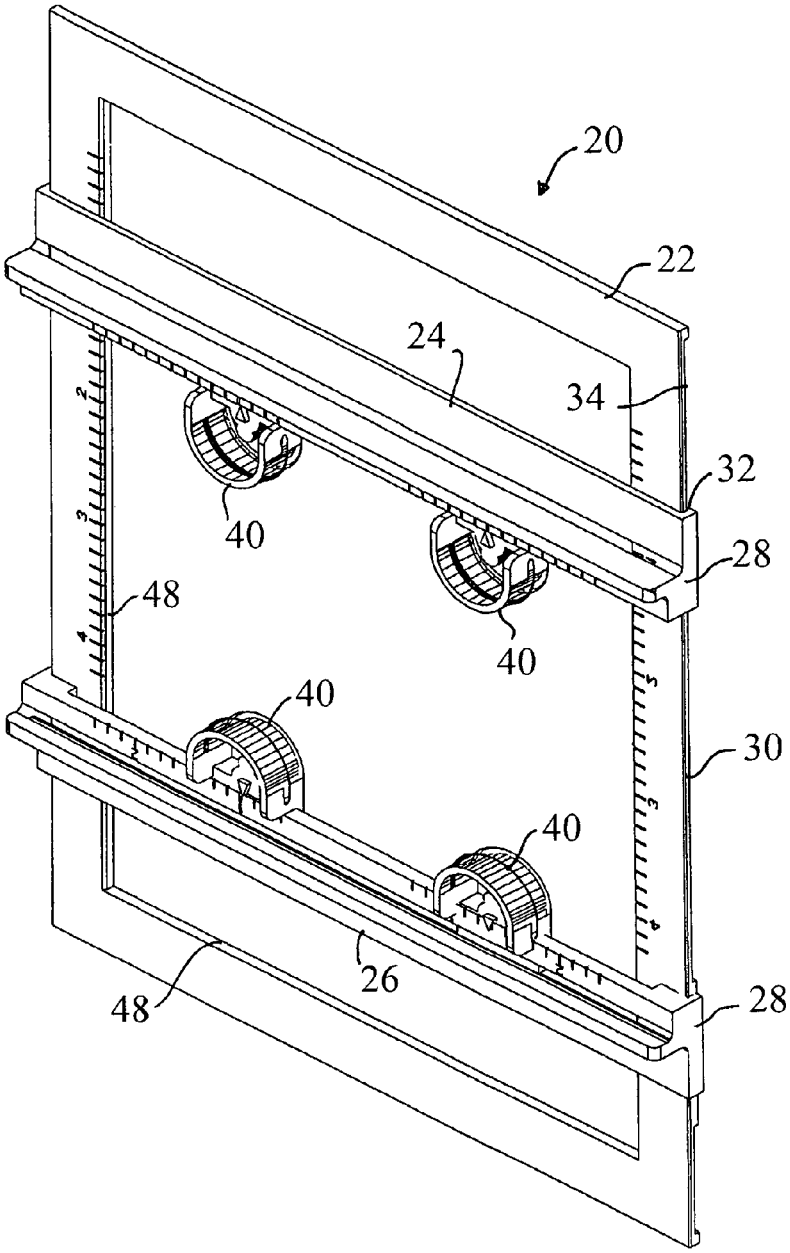
FIGS. 1-6 show a device according to one embodiment of this invention.
Figure 2:
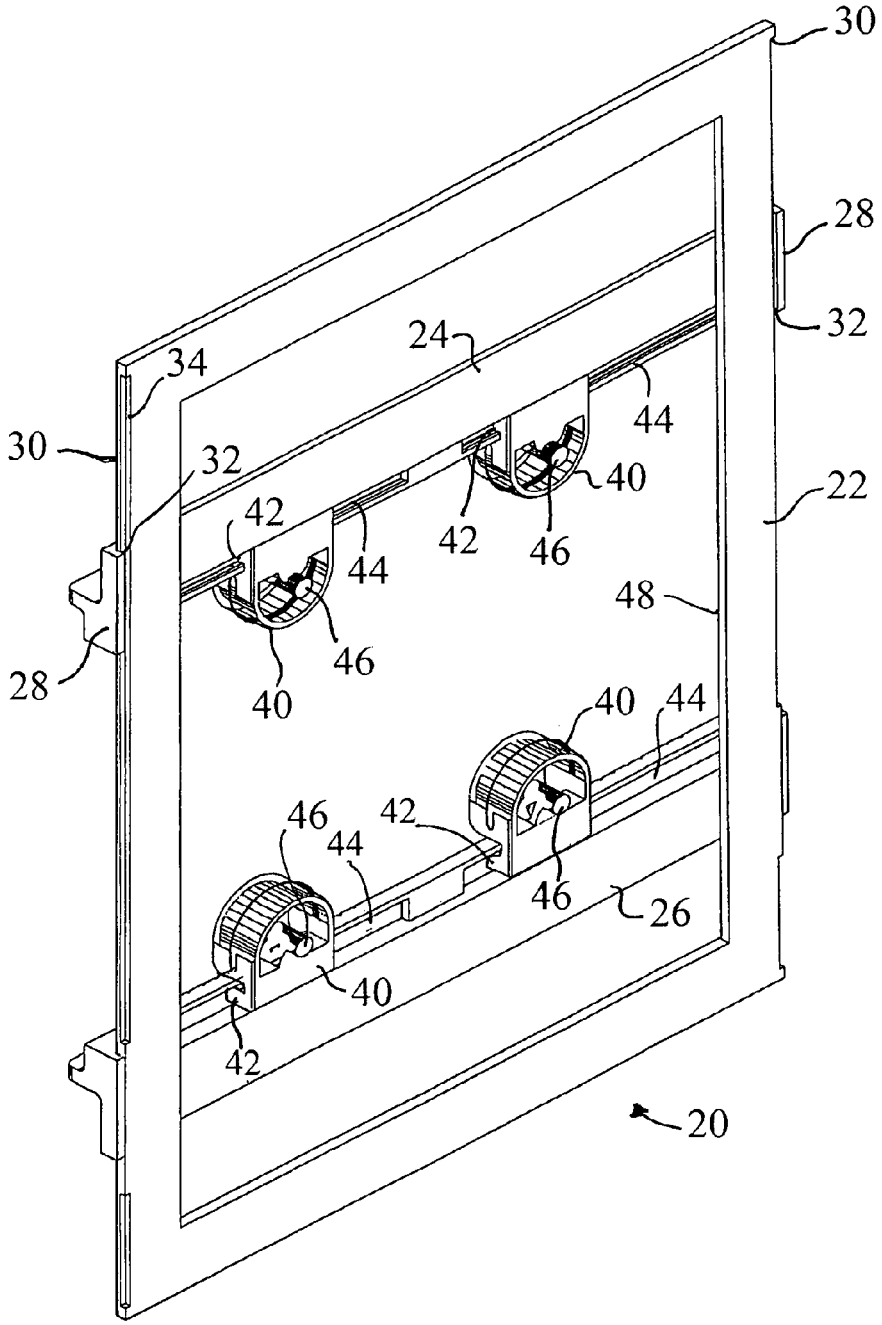
Figure 3:
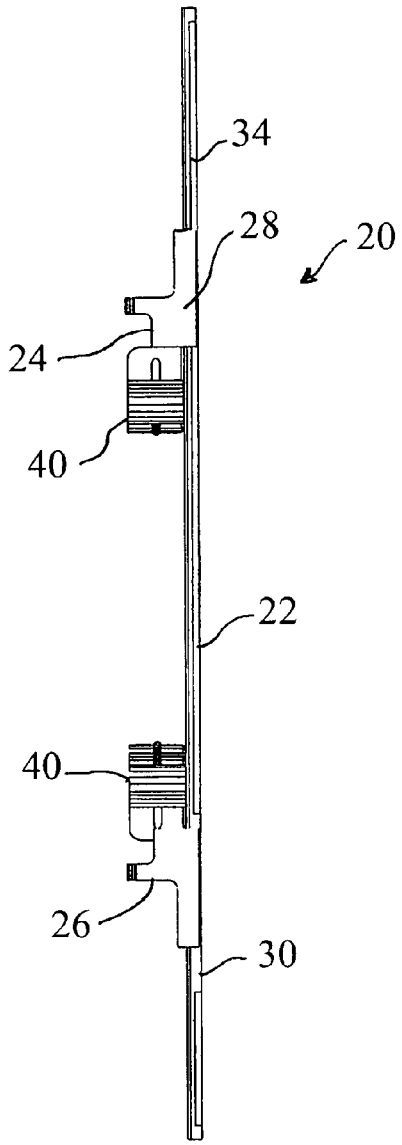

As shown in FIGS. 1 and 2, the first object alignment element 24 includes opposing sides 28 that extend around sides 30 of the base 22. The side arms include tabs 32 that correspondingly fit and move within a groove 34 formed on the opposing sides 30 of the base 22. The first object alignment element 26 can be similarly structured to move along and over the base 22, but is shown in FIGS. 1 and 2 as having sides 28 that are fixed in place on the base 22.

The device 20 further includes a plurality, and more particularly four, second object alignment elements 40. Two of the second object alignment elements 40 are connected to the first object alignment element 24 and the other two of the second object alignment elements 40 are connected to the first object alignment element 26. Each of the second object alignment elements 40 is independently movable laterally along the corresponding first object alignment element 24 or 26 to be placed in the desired position over a label assembly placed thereunder. Each of the second object alignment elements 40 includes a slide 42 that fits and slides within a groove 44 in the corresponding first object alignment element 24 or 26. In the embodiment shown in FIGS. 1-6, the grooves 44 are disposed on an underside of the first object alignment elements 24 or 26, but the grooves can be in the top or side surface as well.

The device 20 further includes a label assembly retaining device for retaining a label assembly beneath the first object alignment elements 24 and 26 and/or the second object alignment elements 40. In the embodiment shown in FIG. 2, the label assembly retaining device includes pins 46 extending from the underside of the second object alignment elements 40. The pins 46 can coordinate with openings (see FIG. 8) in one or more layers of a label assembly to assist in securing the label assembly under alignment elements.

In one embodiment of this invention, as shown in FIGS. 1-6, the label assembly retaining device further includes an inner side wall 48 of the base 22. At least one edge or corner of a label assembly can be placed abutting the inner side wall 48 of the base 22. In such embodiments, the pins 46 add an extra level of restraint, securing the label assembly against the side wall 48, and also desirably act as placement markers to allow the second object alignment elements 40 to be placed in the proper positions about the exposed adhesive of the label assembly.

Figure 4:
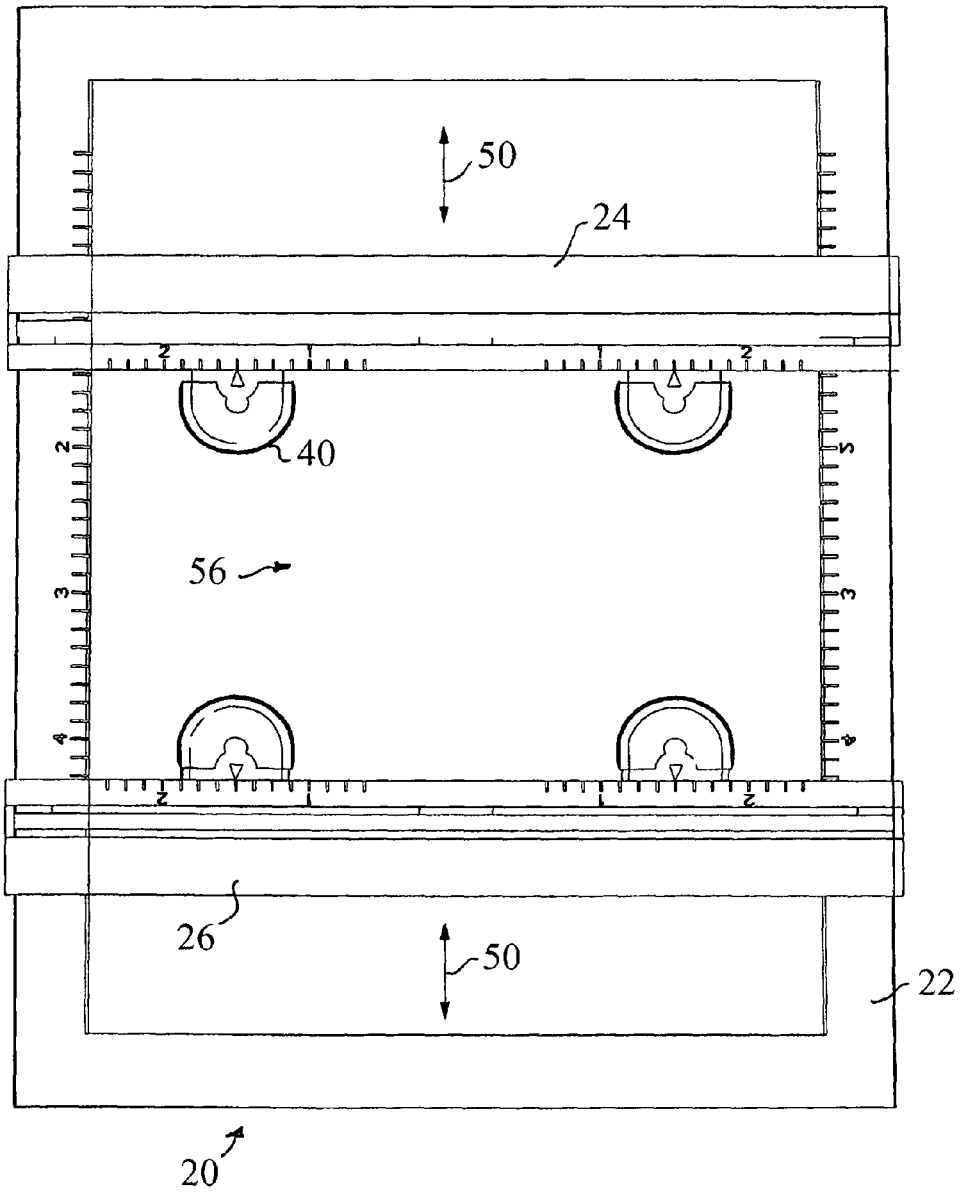
Figure 5:
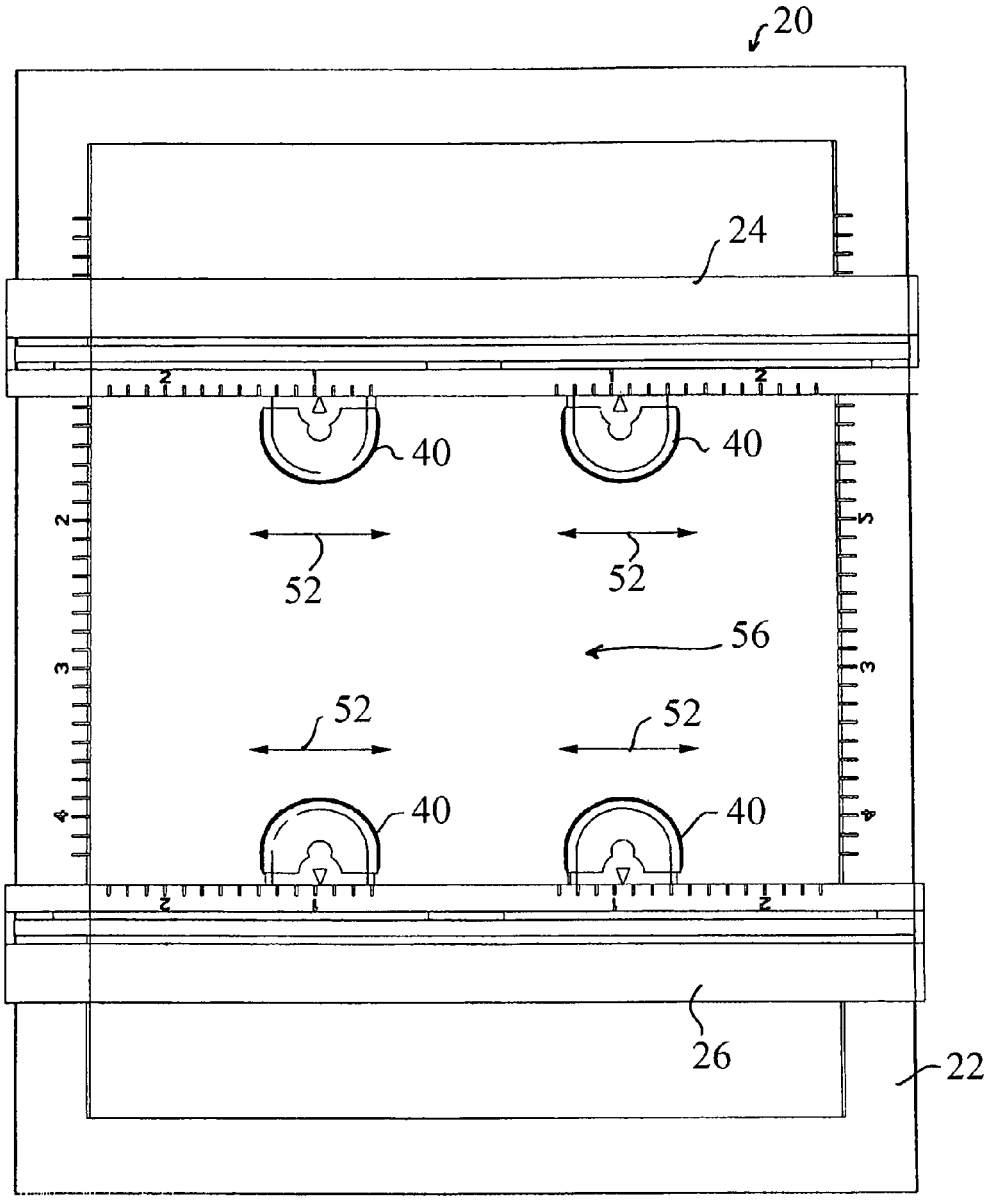
Figure 6:
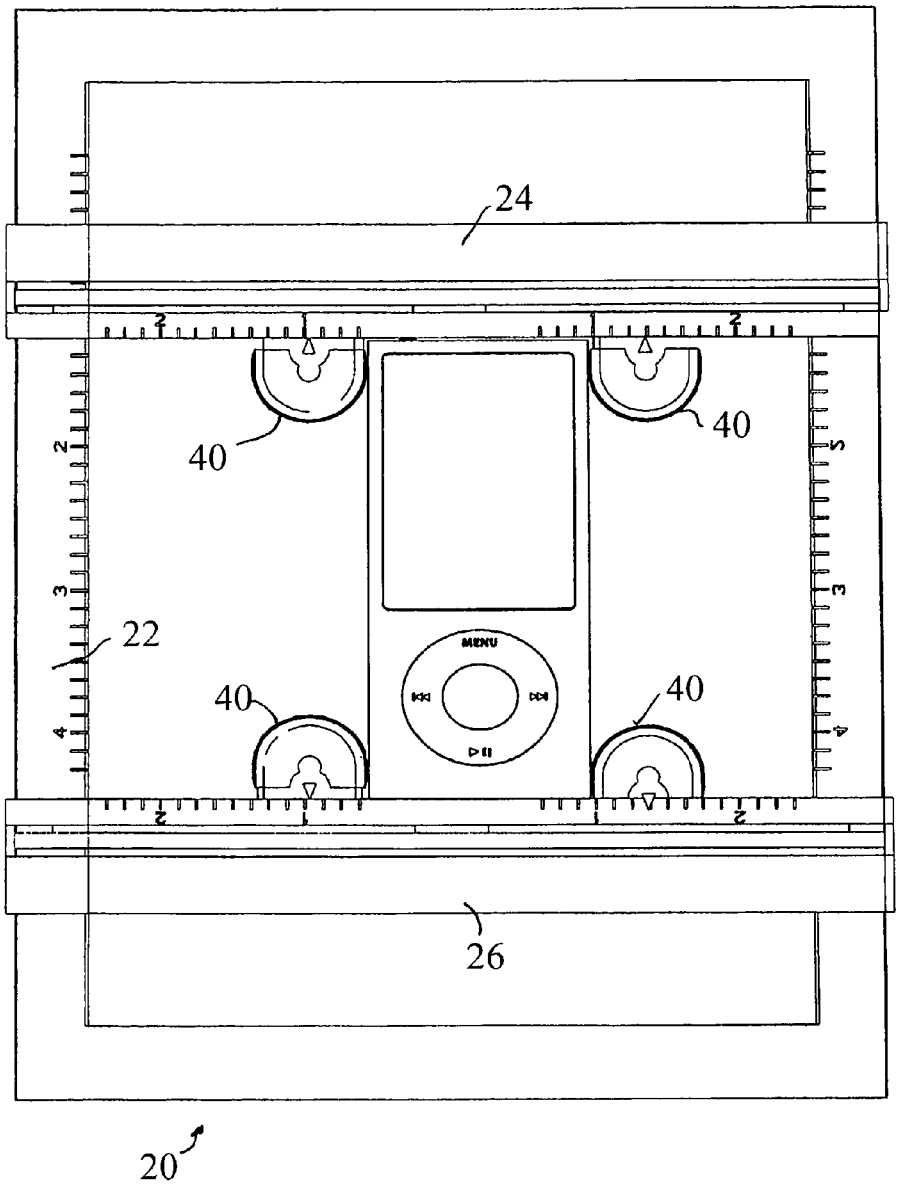

The first object alignment elements 24 and 26 together with the second object alignment elements 40 provide a moveable frame for use with more than one object having different sizes, e.g., different types of electronic music players or cellular phones, etc. FIG. 4 includes arrows 50 that illustrate the movement capabilities of the first object alignment elements 24 and 26. FIG. 5 includes arrows 52 that illustrate the perpendicular movement capabilities of the second object alignment elements 40. Each of the alignment elements is moved to a desired position over a label assembly, and at a distance from each other to frame and accept there between an electronic device, such as the digital music player shown in FIG. 6. The alignment elements are desirably positioned over the label assembly in a position to create a chute 56 to receive the object, where the chute 56 formed has a size just larger than the object to allow the object to be dropped, lowered, or otherwise placed down on the exposed adhesive between the alignment elements.

In one embodiment of this invention, the base and/or the first object alignment elements can include distance markers to assist in the proper placement of the alignment elements. The base 22 and first object alignment elements 24 and 26 shown in FIGS. 1-6 include ruler markings to show the distance apart and the size of the formed chute. The apparatus of any embodiment of this invention may include markings or molded stop positions corresponding to preset sizes for popular devices to facilitate the movement of the arms into the desired position for a particular device. The device can also be object specific, wherein the chute is fixed to a particular size to accept a particular device, such as an IPHONE® smartphone or IPOD® music player.

As will be appreciated by those following the teachings herein provided, various sizes, shapes, connections, and configurations are available for the base, first alignment elements, and second alignment elements of this invention. The device can also be formed of various materials, but is desirably formed of plastic, with pieces that can snap together to form the final device.

Figure 7:
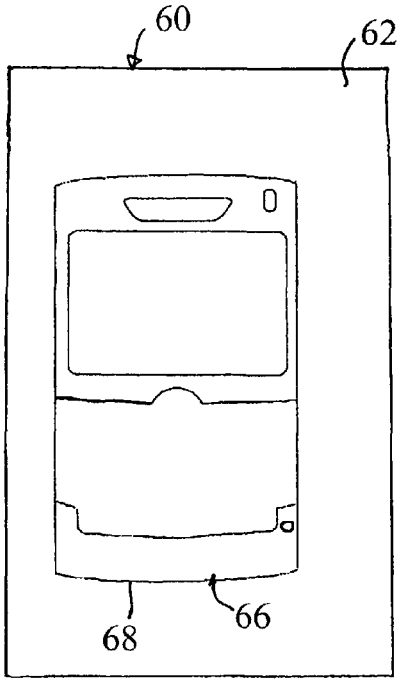
FIGS. 7 and 8 show a label assembly for use in the apparatus of this invention.
Figure 8:
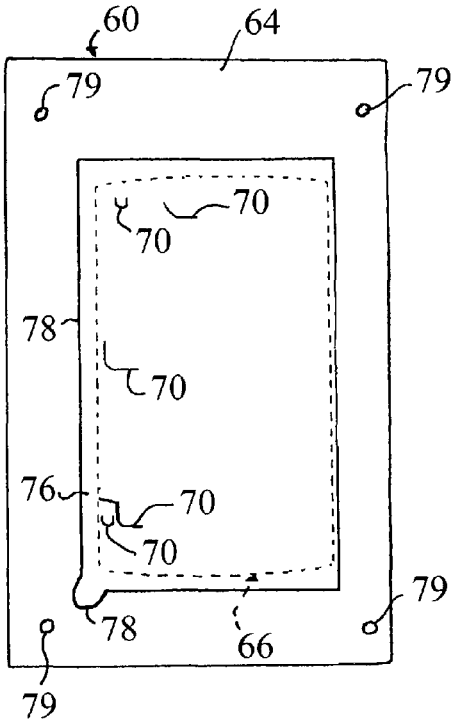

FIGS. 7 and 8 show the front and back, respectively, of an exemplary label assembly 60 for use in the label application devices of this invention. Label assembly 60 includes a face sheet 62 having a printed or printable surface, shown in the view of FIG. 7, and an adjacent back sheet 64, shown in the view of FIG. 8. The surface of the face sheet 62 that is disposed toward the back sheet 64, and opposite the printed or printable surface, includes an adhesive material coating. The adhesive coating can include any adhesive material known and available to those skilled in the art for forming pressure sensitive, or self-adhesive, labels, and can be applied to the face sheet 62 in any suitable manner known to those skilled in the art.

The face sheet 62 is preferably, but not necessarily, constructed of any suitable paper, paper composite, non-metal and/or metal material that can be used as a label. Other suitable materials for constructing the sheet 62 include fabric, plastic, and metal foils. The face sheet 62 and the printable surface can be any of a variety of face materials used to make pressure sensitive or self-adhesive labels. Such face materials may include, but are not limited to: smudgeproof stock, litho stock, cast coated stock, tag stock, fluorescent stock, foils, computer printable polyester, vinyl, satin cloth, Tyvek™ material, flexible plastic, book papers, photo quality papers and/or photo quality film. Furthermore, various portions of the face materials can be different colors, thereby resulting in different colored parts.

The phrase "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention. The face sheet can also be pre-printed by the manufacturer or retailer with graphics and/or test desirable to a consumer user. The printed surface can include any desirably image or text, or can be colored or include holographic images.

The label assembly 60 shown in FIGS. 7 and 8 includes a label shape 66. The label shape 66 is defined at an outer periphery by a tearable line of separation 68. In the embodiment of the invention shown in FIGS. 7 and 8, the label shape 66 is 14 MDS designed to be applied to a cell phone or smartphone, such as a BLACKBERRY® smartphone, but other sizes and shapes of label shapes for other devices, such as consumer electronics or objects, can be used as well.

The phrase "label shape", or the phrase "shape", is intended to relate to a shape, such as, but not limited to, the shapes identified in FIG. 7, that can be torn away from a remaining portion of the face sheet 62, by using tearable lines of separation. The term "tearable lines of separation," also referred to as simply "tearable lines," "lines of separation" or "separation lines," relate to physical or structural lines that can be torn to separate a removable portion or section from the remaining portion or section of the label and/or the label assembly according to this invention. The label portion of this invention may further include additional separation lines and/or lines of weakness and/or fold lines to aid in positioning and/or adhering the label around an object. Lines of separation and/or lines of weakness according to this invention can be formed of a die-cut line, a laser die-cut line, a score cut line, a perforation line (such as having a plurality of cuts and ties), a microperforation line, a chemically etched line, a liquid etched line, a gas etched line, or any combination of these types of separation, or any other suitable structure that enables separation. A preferred type of tearable line 68 is a line that is die-cut. The label shape 66 can be die-cut along at least a portion of a periphery, such that the label shape 66 can be easily removed or separated from the remaining portion of the sheet 62.

As shown in FIG. 7, the label shape 66 includes additional shapes defined within the periphery by additional tearable lines of separation. Label shape 66 includes internal shapes which correspond to object features such as the view screen of the smart phone, the keyboard, decorative features, and functional features such as, for example, microphone and/or speaker openings of the smart phone. As shown in FIG. 8, the back sheet 64 can include arcuate or otherwise corresponding die cuts 70, respectively, along a portion of the face sheet shapes to assist in maintaining the connection of shapes to the removable panel 76 during removal using removal tab 78.

Removable panel 76 is defined in the back sheet 64 by at least one tearable line of separation 78 extending around the outer periphery of the removable panel 76. The removable panel 76 is disposed over label shape 66. In this embodiment of the invention, the removable panel 76 is not exactly coextensive with label shape 66 and extends beyond the label shape 66 on all four sides. In this embodiment, as only one side of the object is to be labeled, the removable panel 76 comprises a single panel to be removed prior to a first adhesion of the label shape 66 to the object. The back sheet 64 also includes removable openings 79 that can be removed to create a place for the pins of the label assembly retaining device.

Figure 9:
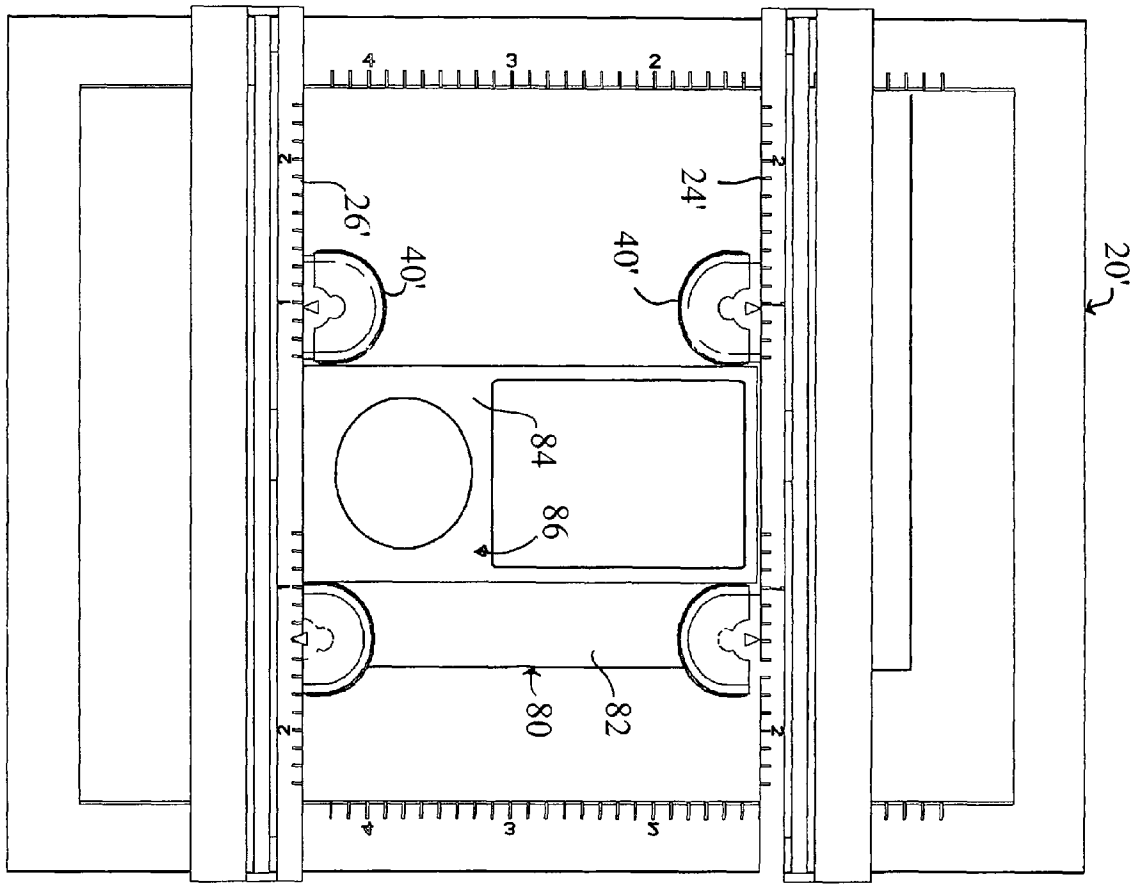
FIGS. 9-11 show the use of a device according to one embodiment of this invention.
Figure 10:
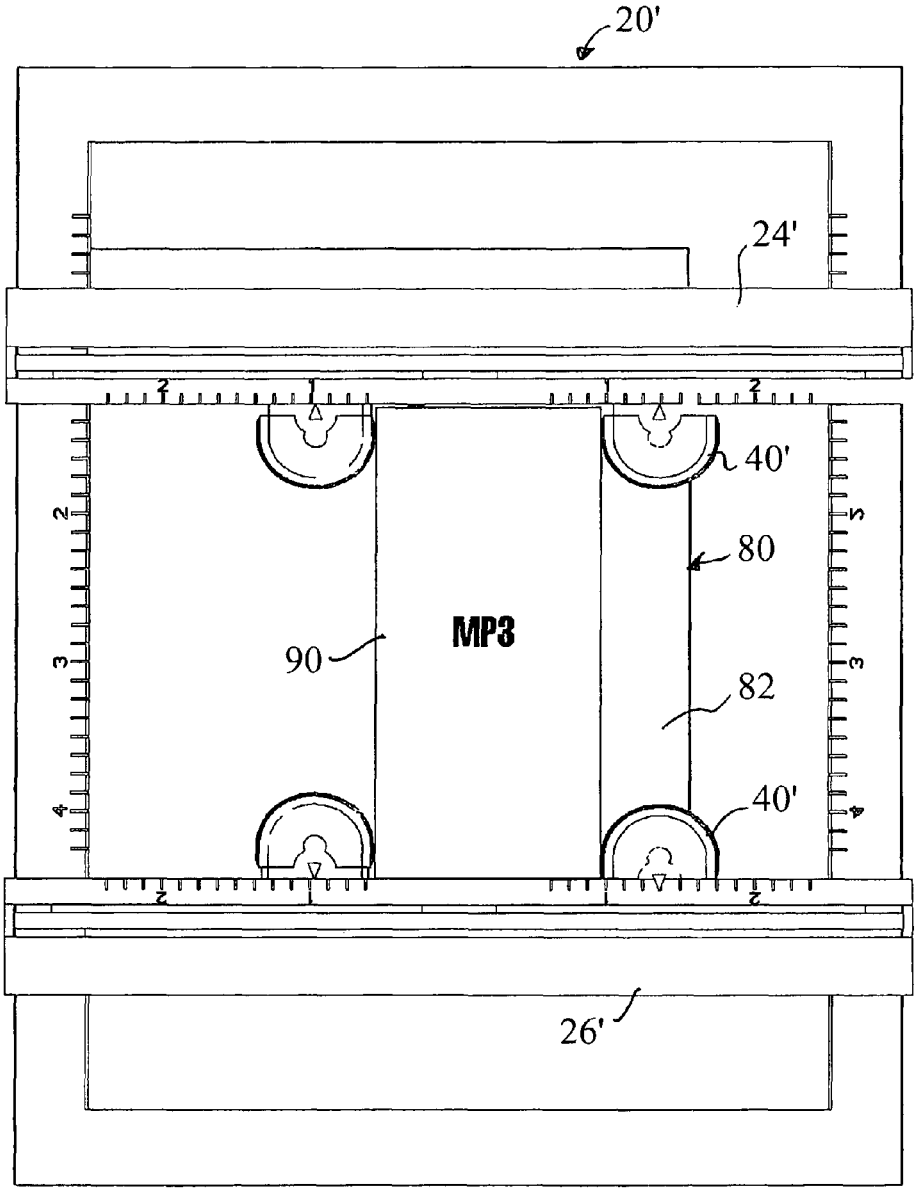
Figure 11:
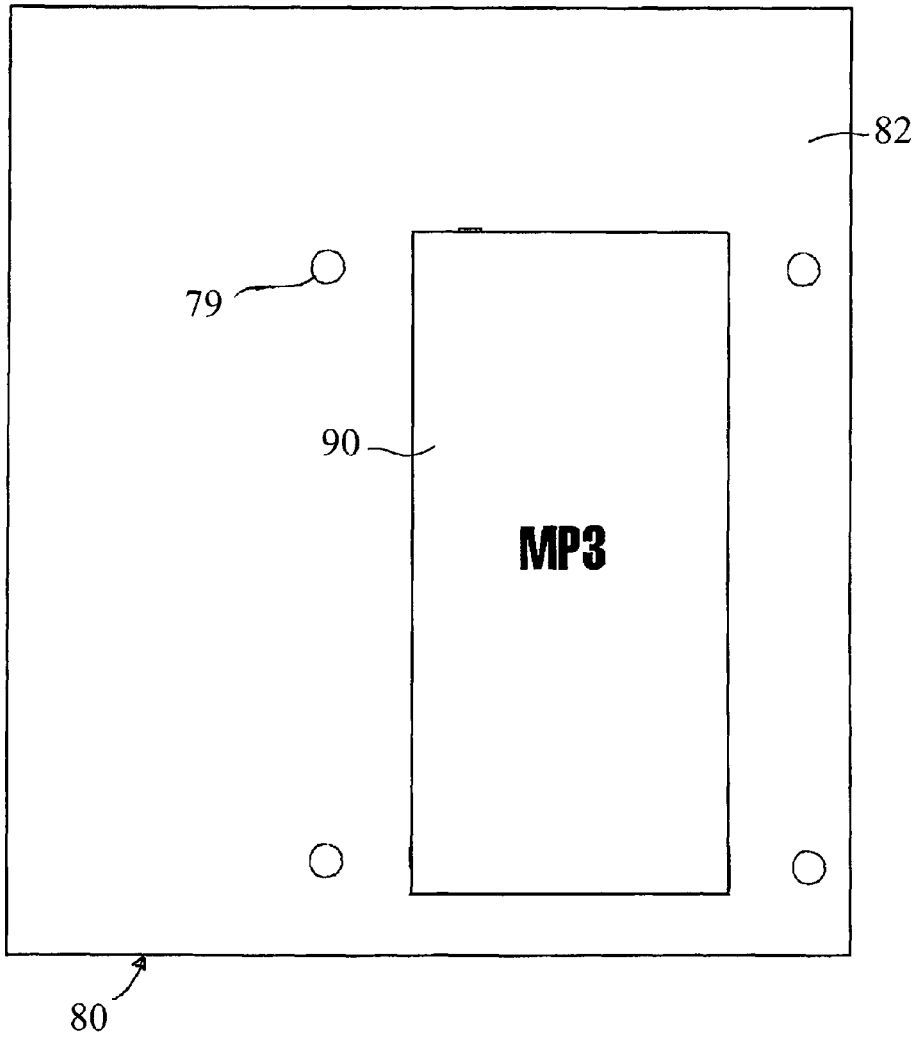

FIGS. 9-11 illustrate the use of a device 20' similar in design to the device of FIGS. 1-6. In FIG. 9, a removable panel has been removed from the back sheet 82 of label assembly 80 to expose the adhesive side 84 of a label 86 for a digital music player. The device 80 is placed over the label assembly 80 and the alignment elements 24', 26', and 40' are placed to frame the exposed label 86. In FIG. 10, the music player 90 is lowered between the alignment elements 24', 26', and 40', which keep the music player 90 in the desired aligned position over the label 86 to provide an aligned adherence of the label 86 to the music player 90. FIG. 11 show the device 20' removed, and now the label 86 is adhered to the music player 90 and the label 86 can be removed from a remaining portion of label assembly 80, and any further label application (e.g., wrapping around the music player) can be performed.

Figure 12:
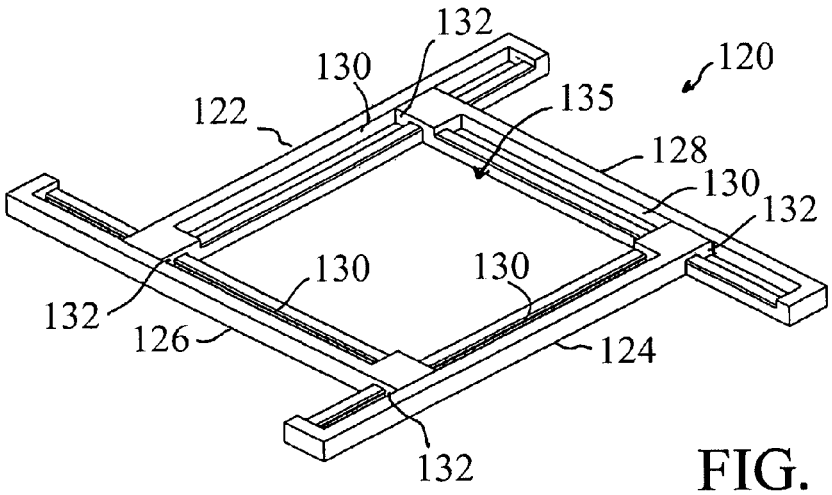
FIGS. 12-15 show a device according to one embodiment of this invention.
Figure 13:
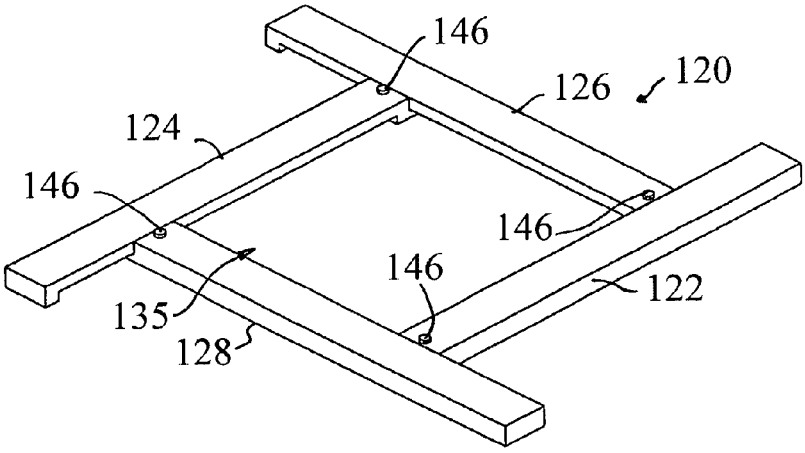
Figure 14:
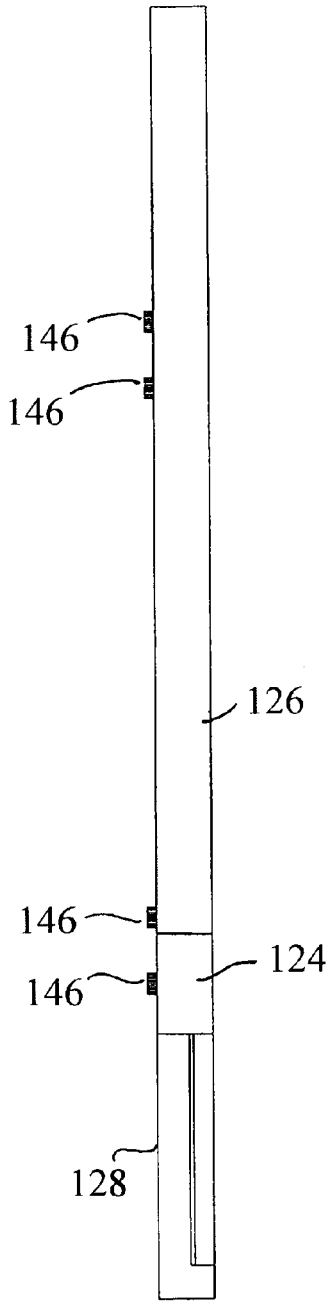

FIGS. 12-14 show a label application device 120 for applying a label to an object, according to another embodiment of this invention. The device 120 includes two parallel first object alignment elements 122 and 124 and, extending perpendicular thereto, two parallel second object alignment elements 126 and 128. Each of the object alignment elements 122, 124, 126, and 128 includes a groove 130 in a top surface and a slide 132 disposed at one end. The slide 132 of each object alignment element 122, 124, 126, and 128 fits and is movable within a groove 130 of an adjacent one of the object alignment elements 122, 124, 126, and 128. The assembly of the object alignment elements 122, 124, 126, and 128 forms the adjustable parallelogram-shaped chute 135 for receiving the object to be labeled.

The object alignment elements 122-128 provide a moveable frame for use with more than one object having different sizes. As each slide 132 moves in the corresponding groove 130, the chute 135 can be adjusted to various sizes and shapes to accommodate multiple objects, such as music players, cell phones, and jewel cases. As will be appreciated, the object to be placed in the chute does not have to have an exactly matching parallelogram shape. Cell phones and music players, for example, are not always perfectly rectangular (e.g., they have rounded corners), but will still have edges and ends that result in a centered position within chute 135. Even round shapes, like DVDs, can be applied using chute 135.

The device 120 further includes a label assembly retaining device for retaining a label assembly beneath the object alignment elements 122-128. As shown in FIG. 13, the label assembly retaining device includes pins 146 extending from the underside of the object alignment elements 122-128. The pins 146 can coordinate with openings in one or more layers of a label assembly as discussed above to assist in securing the label assembly under the alignment elements 122-128.

In one embodiment of this invention, the object alignment elements 122-128 can include distance markers to assist in the proper placement of the alignment elements 122-128. The device may include markings or molded stop positions corresponding to preset sizes for popular devices to facilitate the movement of the arms into the desired position for a particular device.

Figure 15:
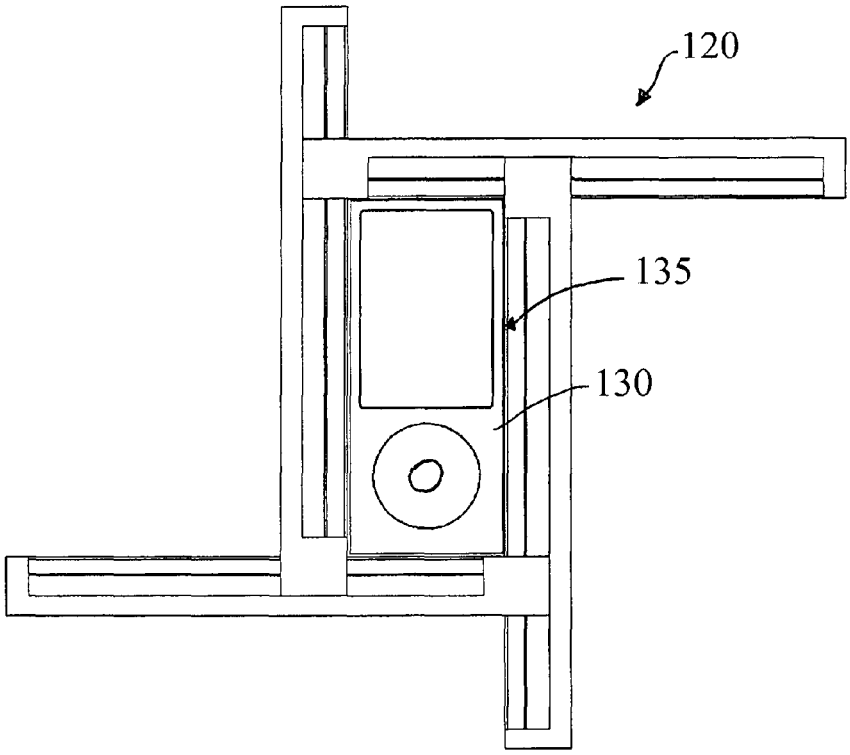

FIG. 15 shows the device 120 including a digital music player 130 disposed within the formed chute 135, which has been appropriately sized for the digital music player 130.

As will be appreciated by those following the teachings herein provided, various sizes, shapes, connections, and configurations are available for the first alignment elements and second alignment elements of this invention. For example, the object alignment elements can alternatively have the grooves and corresponding slides formed in the side or bottom surfaces. The device can also be formed of various materials, but is desirably formed of plastic, with pieces that can snap together to form the final device.

Embodiments of this invention discussed above function by creating a chute into which at least a part of the object to be labeled is lowered and/or dropped in an aligned position over an exposed adhesive material of a label. The invention also includes a method of applying a label to an object that includes removing at least a portion of a back sheet from a label assembly to expose an adhesive material on at least a portion of a label of the label assembly and lowering or dropping the object on the exposed adhesive material through the chute formed by the device and framing the exposed adhesive of the label.

Figure 16:
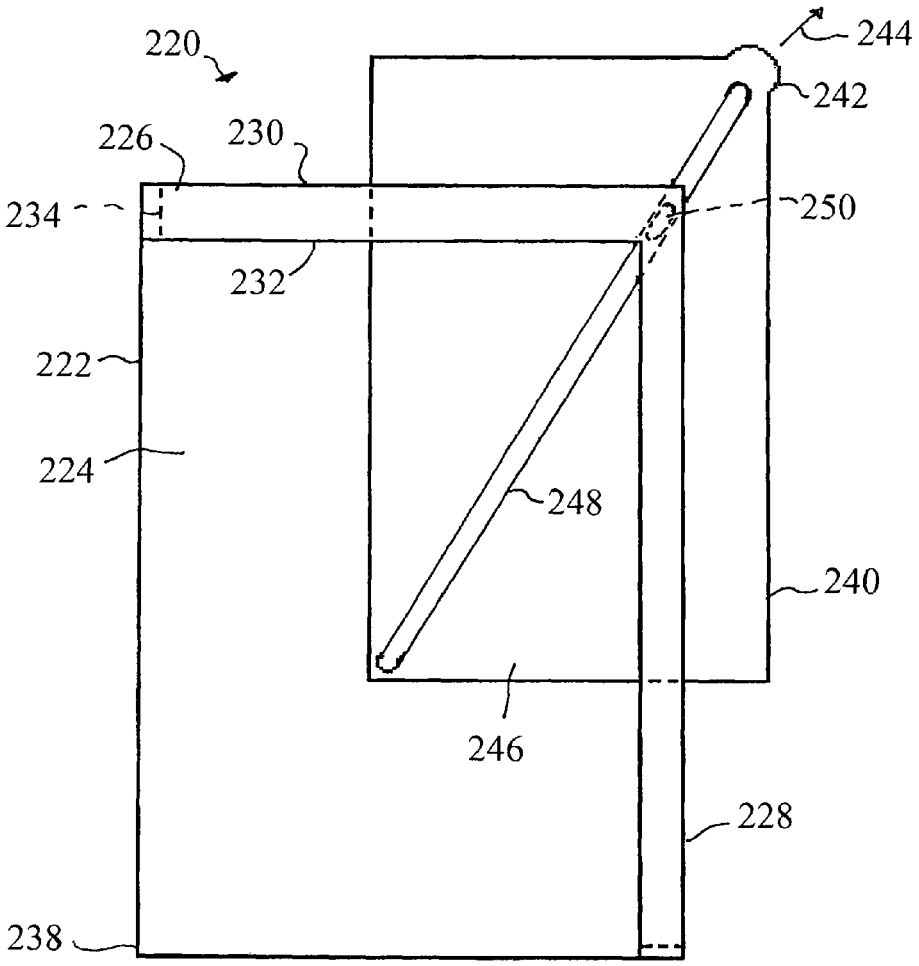
FIG. 16 is a top view of an apparatus for applying a label according to one embodiment of this invention.
Figure 17:
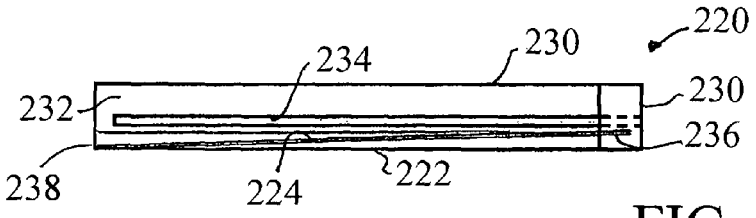
FIG. 17 is a side view of the apparatus according to FIG. 16.

FIGS. 16 and 17 illustrate a label application device 220 for applying a label to an object, according to another embodiment of this invention. The device 220 includes a base 222 defining a label application surface 224. As explained further below, a label assembly is placed on the label application surface 224 during use. The second alignment element is embodied as an object support element 240 spaced apart from and movable, such as laterally, over the label application surface 224.

A raised edge 230 extends along a first side 226 and a perpendicular second side 228 of the base 224. An inside wall 232 of the raised edge extends along perpendicular sides of the label application surface 224. The raised edge 230 includes a slit groove 234 as an opening extending through the raised edge 230 at a spaced distance from the label application surface 224. The object support element 240 is disposed within the slit groove 234 and is laterally movable within the slit groove 234 over the label application surface 224.

FIG. 17 is a side view of the base 222 without the object support element 40 for explanation purposes. FIG. 17 shows the slit groove 234 extending nearly an entire length of the raised edge 230. The size shape and configuration of the slit groove 234 can be varied to correspond with alternative sizes, shapes, and configurations of the object support element 240.

The slit groove 34 desirably has a length within the raised edge 230 to have a user to insert the object support element 240 to a position disposed over the label application surface 224. During use the user would place a label assembly, with an exposed label adhesive side facing up, on the label application surface 224. The object to be labeled is placed on the object support element 240, which supports the object over the label assembly. The user pulls the object support element 240 through the slit groove 234, such as using a handle, e.g., grasp tab 242, thereby pulling the object support element 240 from under the object in the direction of arrow 244. The removal of the object support element 240 allows the object, which is held in place by the inside wall 232 of the raised edge 230, to drop onto the exposed adhesive below to place the object onto the label adhesive in the desired aligned position.

As shown in FIG. 17, the device 220 includes an optional recess 236 extending between a portion of the raised edge 230 and the base 222. The recess 236 extends the label application surface 224 beneath the portion of the raised edge 230. As label assemblies typically include a remaining matrix surrounding a label, the recess 236 receives an edge portion of the label assembly, thereby allowing the label of the label assembly to be positioned beneath the object held in the corner of the raised edge 230. Other structures instead of recess 236, such as pins or posts extending from the inside wall 232, can be used to appropriately position the object over the label assembly below.

FIG. 17 also illustrates an option for the label application surface 224. In FIG. 17, the label application surface 224 extends downward at an angle along or away from the raised edge 230. The downward slant of the label application surface 224 can be used to compensate for angular shift of the dropping object due to one side or corner of the object leaving the object support element 240 before the other side or corner. The sloping label application surface 224 is desirably angled to be substantially parallel to the object when the falling object contacts the label on the label application surface 224. In the embodiment of FIG. 16, the label application surface slopes from each of the first side 226 and the second side 228 toward corner 238, due to a diagonal removal of the object support element 240 (indicated by arrow 244). However, different or no sloping can be used depending on need. For example, the embodiment of FIGS. 19 and 20 may only need a slope in one dimension due to the different direction the object support element travels.

In the embodiment of FIG. 16, the object support element 240 includes an object support surface 246 for receiving the object to be labeled and extending substantially parallel with the sloping label application surface 224. The object support element 240 includes an optional channel groove 248 which operates with a slide 250 fixed within in the slit groove 234 at the corner intersection of the first side 226 and the second side 228. The channel groove 248 and slide 250 operate to ensure a proper and desired diagonal movement of the object support element 240. The slide 250 can also serve as a stop for the movement of the object support element 240, so that the object support element 240 does not fully remove from the slit groove 234. The slide can be any suitable shape, such as a circle, square, rectangle, or ellipse, but is preferably an elongated shape, such as a rectangular or elliptical block, for the block- or post-like embodiment of claim 16 to limit twisting movement of the object support element 240. The slide 250 can be inserted in an opening on one side of the raised edge 230, or can be disposed between two portions forming the raised edge 230.

The device 220 is desirably made of plastic and has a size that corresponds to one or more objects to be labeled. As will be appreciated by those skilled in the art following the teachings herein provided, various and alternative sizes, shapes, and configurations are available for components of the application device of this invention, including the base, label support surface, raised edge, slit opening, and object support element.

Figure 18:
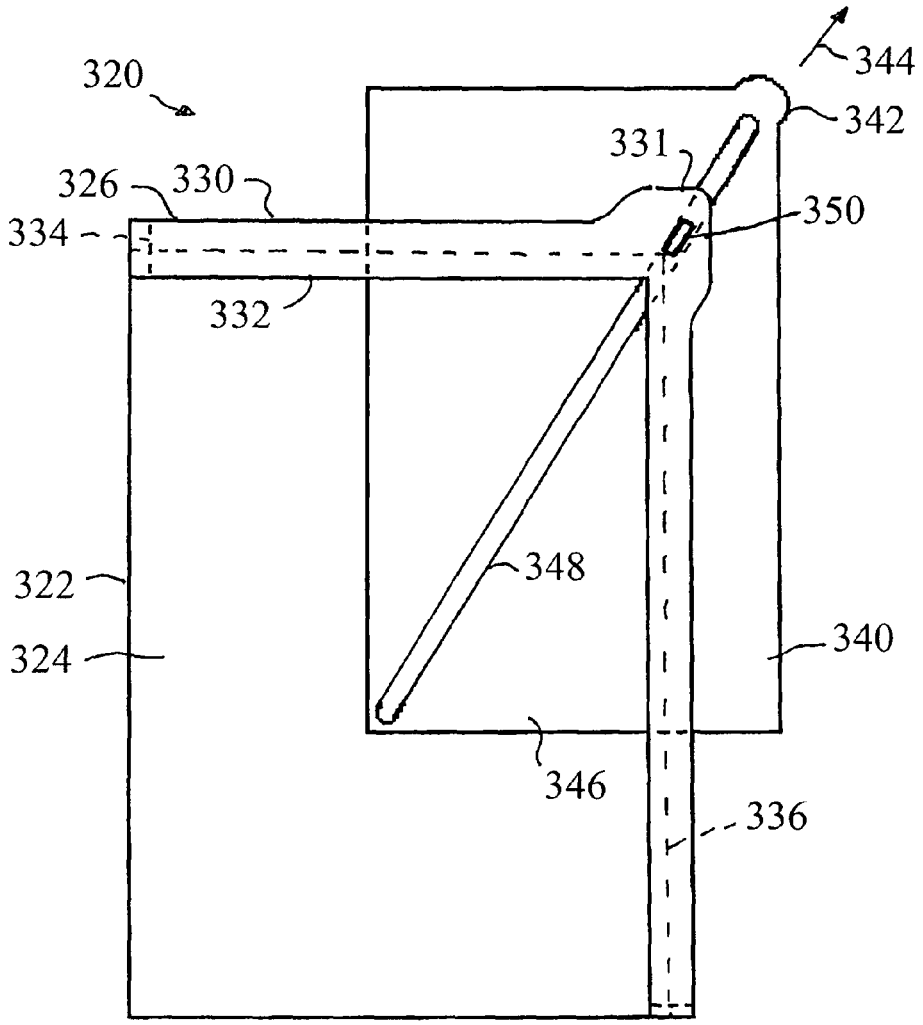
FIG. 18 is a top view of an apparatus for applying a label according to another embodiment of this invention.

FIG. 18 illustrates a modification for the device 220 of FIG. 16. In FIG. 18, the raised edge 330 of the device 320 includes an extended portion 331. The slide 350 is disposed in the extended portion 331 to move the slide 350 away from the recess 336. In this manner, the slide 350 can be inserted through an opening extending the entire depth of the raised edge 330.

Figure 19:
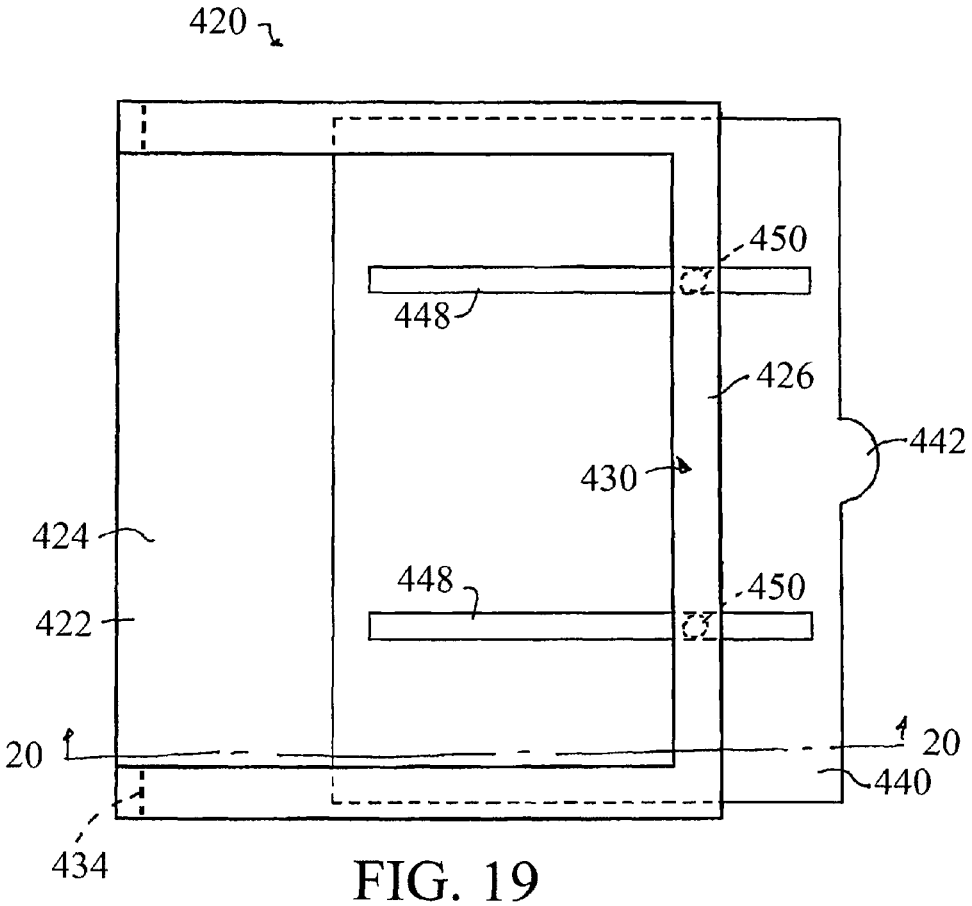
FIG. 19 is a top view of an apparatus for applying a label according to another embodiment of this invention.

FIG. 19 illustrates a label application device 420 for applying a label to an object, according to another embodiment of this invention. The label application device 420 operates in an analogous manner to the device 220 discussed above. The label application device 420 includes a raised edge 430 that extends around three sides of base 422 and label application surface 424. A slit groove 434 extends through all three sides of the raised edge 430. An object support element 440 extends over the label application surface 424 and is pulled laterally from raised edge side 426 instead of the diagonal direction shown in FIG. 16.

The object support element 440 includes two parallel channel grooves 448 that move around slides 450 disposed in the slit groove 434. As discussed above, the channel grooves 448 and slides 450 facilitate the movement of the object support element 440 and can keep the object support element from being fully removed from the slit groove 434. Alternative structures can also be used to provide the functions of the channel grooves 448 and slides 450. For example, in the embodiment of FIG. 19, the lower surface edge of the object support element 440 that is opposite handle tab 442 can include a raised lip that extends between the two opposing inside walls of the raised edge 430. Alternatively or additionally, the side edges of the object support element 440, either within or adjacent to the raised edges, can include as a slide raised lips or similar features that work with a corresponding grooves, e.g., tracks, within the raised edge 430.

Figure 20:
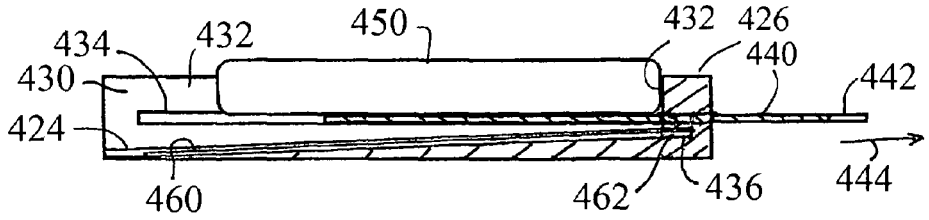
FIG. 20 is a sectional side view of an apparatus of FIG. 19 in use with an object and a label assembly.

FIG. 20 is a sectional side view of the device 420 shown in FIG. 19, including an object 450 and a label assembly 460 to demonstrate a method of operation. The label assembly 460 has a removable panel in the back sheet removed (such as discussed above), and is placed face sheet down on the label application surface 424, which is downwardly sloped in FIG. 20, and has an edge 462 in recess 436. The object 450 is placed on the upper surface of the object support element 440. A corner of the object 450 is placed in one of the corners of the raised edge 430 with at least two sides of the object 450 touching two inside walls 432 of the raised edge 430.

The object support element 440 is then moved in a direction of arrow 444 to move the object support element 440 from beneath the object 450 to drop at least a portion of the object 450 onto the exposed adhesive material of the label assembly 460. The object 450 with the adhered label assembly can then be removed from the device 420. The label shape can be further secured to the object 450 if needed, and then removed from the remaining portion of the label assembly 460. Depending on the label shape, the user can finalize the application of the label to the object 450, such as by wrapping a further portion of the label shape around the other sides of the object 450.

Figure 21:
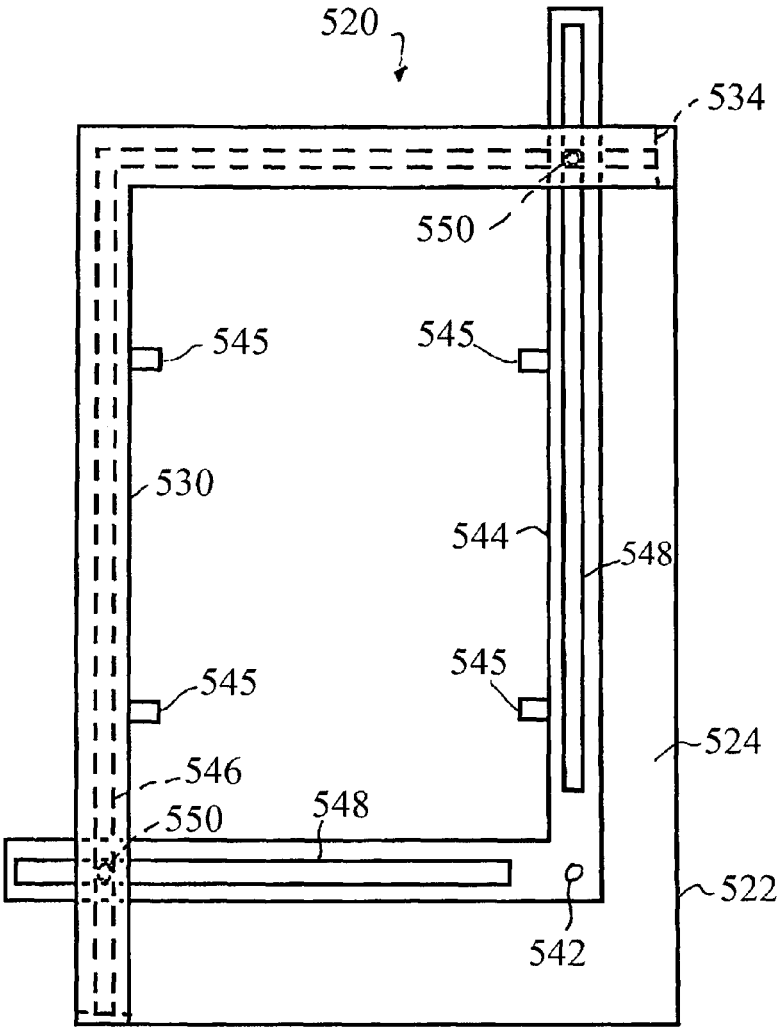
FIGS. 21-24 are each a top view of an apparatus for applying a label according to different embodiments of this invention.
Figure 22:
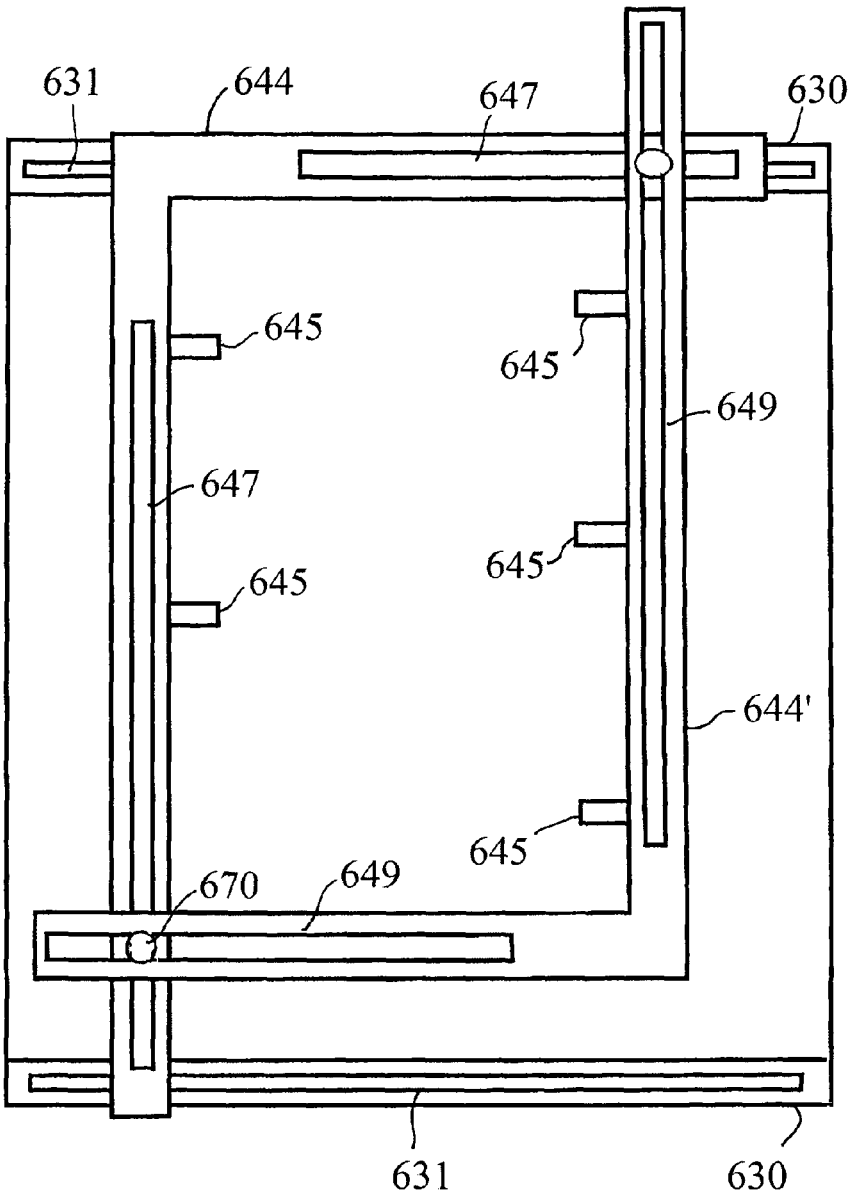

FIGS. 21 and 22 illustrate devices according to other embodiments of this invention, which include arms instead of a plate-like surface as the object support element. In FIG. 21, a label application device 520 includes a raised edge 530 that extends around two sides of base 522 and label application surface 524. A slit groove 534 extends through both sides of the raised edge 530. An object support element is embodied as four object support tabs 545 extending over the label application surface 524. Two of the tabs 545 extend from the raised edge 530 and another two tabs 545 extend from L-shaped arm 544. The L-shaped arm 544 is connected to the raised edge by extending through slit groove 534. The L-shaped arm 544 also extends over and across the label application surface 524.

The arm 544 is laterally moveable over the label application surface 524, such as by handle 542, to position the two tabs 545 a suitable distance from the other two tabs 545 to receive the object to be labeled thereon. The arm 544 includes two channel grooves 548 that move along a corresponding slide 550 within the slit groove 534. The slides 550 float, i.e., are not connected, within a channel groove 246 within slit groove 534, thereby allowing the arm 544 to move vertically, horizontally, or diagonally at any angle across the label application surface 524 to position the tabs 545 in the needed spacing to receive the object. Once the label assembly (not shown) is placed on the surface 524, and below the arm 544, with the exposed adhesive facing upwards, the object can be placed on the tabs 545. The arm 544 is moved to drop a portion of the object onto the exposed adhesive. In one embodiment, the tabs 545 of raised edge 530 are desirably formed of a size and material that reduces frictional forces on the object to allow the object to remain in the aligned position during arm 244 movement. However, the object can also be held in position by an element or merely the user's finger. Alternatively, the object can be pushed down from bendable tabs spaced slightly over the label assembly to adhere the object without moving the arm 544.

Various sizes, shapes, positions, and configurations are available for the raised edge, tabs, arms, and other components shown in FIG. 21. For example, FIG. 22 illustrates an alternative embodiment with two L-shaped arms 644, each including tabs 645, which move along channels in two opposing raised edges 630. Each raised edge 630 includes a channel groove 631 in which slides (not shown) of a first arm 244 move in one direction. The first arm 644 includes further channels 647 and second arm 644' includes two similar channel grooves 649. An I-shaped slide 670, or other suitable configuration, allows the second arm 644' to move relative the first arm 644, while also holding the second arm 644' to the first arm 644.

As discussed above, embodiments of this invention function by lowering or dropping at least a part of the object to be labeled in an aligned position over an exposed adhesive material of a label. The object can be dropped from an object support element by removing at least a portion of the object support element from under the object. However, the object can be lowered dropped without the need for a moving or any object support element as well.

Figure 23:
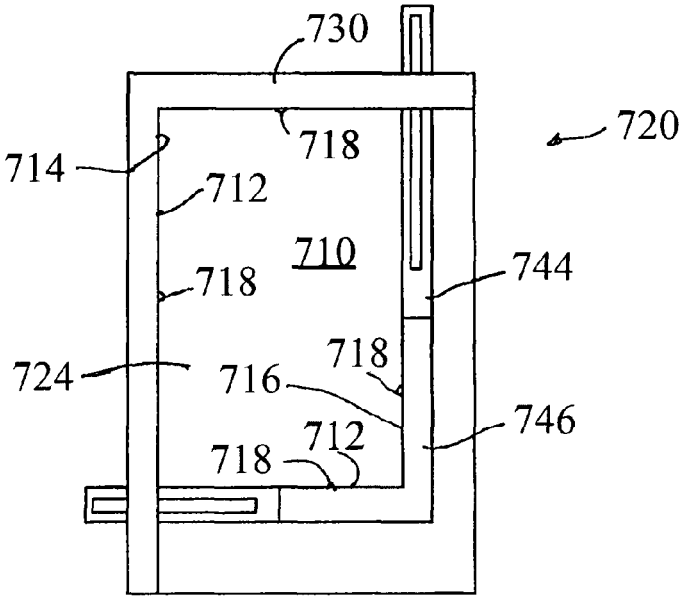
Figure 24:
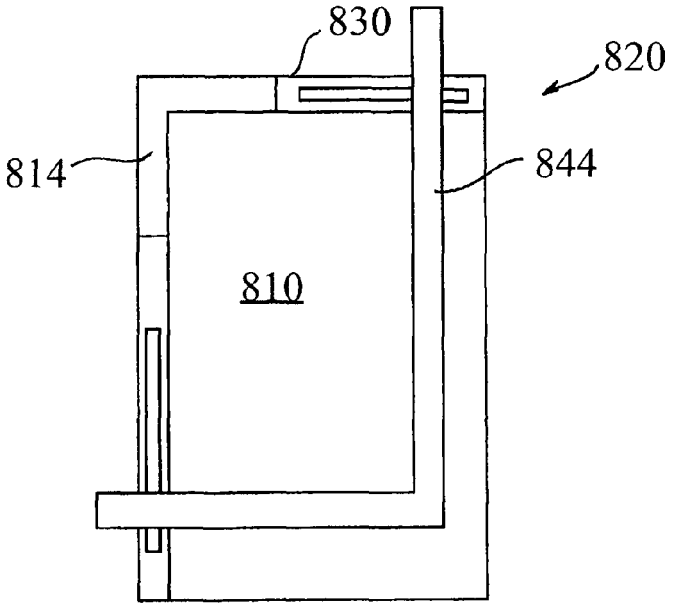

FIGS. 23 and 24 illustrate devices according to other embodiments of this invention, including an arm moveable relative to a raised edge. A chute is defined by a portion of the raised edge and a portion of the arm. In FIG. 23, the device 720 includes arm 744 above and spaced apart from the label application surface 724 and extends through the raised edge 730, such as discussed above in FIG. 21. The arm 744 includes a raised portion 746 to match the height of the raised wall 720, thereby forming the chute 710 there between. The chute inner wall 712 is not continual around the chute 710, thereby allowing for the mechanism of adjustment for more than one type of object. The chute 710 includes at least two corner walls 714 and 716 to ensure an at least substantially square or rectangular object is dropped in the aligned position. The object is held over or within the chute 710 by the user or some small optional projections 718 within the chute 710, and dropped (or dropped by pushing off elements 718) onto the exposed adhesive of a label below the chute 710. FIG. 24 illustrates another embodiment of a device 820 where the arm 844 is disposed on the raised wall 830, and the raised wall 830 includes a raised corner portion 814 to form the chute 810.

The apparatus of any embodiment of this invention may include markings or molded stop positions corresponding to preset sizes for popular devices to facilitate the movement of the arms into the desired position for a particular device. The apparatus can also be object specific, wherein the chute is fixed to a particular size to accept a particular device. In such embodiments, the chute wall can be more or completely continuous around the chute.

Thus, the invention provides an apparatus a method for labeling objects, and particularly cell phones, smartphones, tablets, laptops, and digital music players, which are difficult to label due to a need to properly align the label around the view screen, control element, and/or other features on the device.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An apparatus for applying a label from a label assembly to an object, comprising:

a pair of first object alignment elements;

a pair of second object alignment elements each directly connected on and movable along one of the first object alignment elements, wherein each of the first object alignment elements and each of the second object alignment elements comprises a groove, and each of the first object alignment elements and each of the second object alignment elements comprises a slide disposed and movable within the groove of an adjacent object alignment element; and a label assembly retaining device adapted to retain the label assembly beneath a portion of the first object alignment elements and a portion of the second object alignment elements, the label assembly retaining device comprising at least one of: a pin extending from each of the pair of second object alignment elements and corresponding to openings in the label assembly, or a side wall surface of a base of the device adapted to receive an edge of the label assembly.

2. The apparatus according to claim 1, wherein each of the pair of first object alignment elements is part of or connected to the base.

3. The apparatus according to claim 1, wherein each of the pair of first object alignment elements is movable over the base.

4. An apparatus for applying a label from a label assembly to an object, comprising:

a base defining a label application surface;

a first object alignment element, wherein the first object alignment element comprises a raised edge along at least one side of the base and the label application surface;

a second object alignment element connected to and movable with respect to the first object alignment element, the second object alignment element comprising an object support element spaced apart from and laterally movable over the label application surface, the object support element including an object support surface and facing away from the label application surface;

a slit groove extending through the raised edge, wherein the object support element is disposed within the slit groove and movable therethrough;

a slide disposed within the slit groove;

a channel groove extending through the second object alignment element, wherein the slide is disposed within the channel groove; and at least one of the base or the first object alignment element comprising a label assembly retaining device adapted to retain the label assembly beneath the object support element.

5. The apparatus according to claim 4, wherein the label application surface extends downward at an angle along or away from the raised edge.

6. The apparatus according to claim 4, wherein the label assembly retaining device comprises a recess extending between a portion of the raised edge and the base, wherein the recess extends the label application surface beneath the portion of the raised edge.

7. An apparatus for applying a label from a label assembly to an object, comprising:

a first object alignment element;

a second object alignment element connected to, and movable with respect to, the first object alignment element;

an adjustable chute formed by and between the first object alignment element and the second object alignment element, wherein a size of the chute is adjusted to receive the object therethrough by moving the second object alignment element with respect to the first object alignment element; and a label assembly retaining device adapted to retain the label of the label assembly beneath the chute, the label assembly retaining device comprising at least one of: a pin extending from the second object alignment element and corresponding to an opening in the label assembly, or a side wall surface of the apparatus.

8. The apparatus according to claim 7, wherein the first object alignment element comprises a groove and the second alignment element comprises a slide disposed and movable within the groove.

9. The apparatus according to claim 7, wherein the first object alignment element comprises a groove, and the second object alignment element comprises a slide disposed and/or movable within the groove of the first object alignment element.

10. The apparatus according to claim 7, further comprising:

a pair of first object alignment elements including one of the first object alignment elements disposed parallel to, and spaced apart from, another of the first object alignment elements; and a pair of second object alignment elements connected to, and movable with respect to, each of the pair of first object alignment elements.

11. The apparatus according to claim 10, wherein each of the first object alignment elements comprises a groove, and each of the second object alignment elements comprises a slide disposed and movable within the groove of one of the first object alignment elements.

12. The apparatus according to claim 10, wherein each of the pair of the second object alignment elements is connected to a different one of the first object alignment elements.

13. The apparatus according to claim 10, wherein the label assembly retaining device comprises at least one of: a pin extending from each of the second object alignment elements and corresponding to openings in the label assembly.

14. The apparatus according to claim 13, wherein the first object alignment element comprises a raised edge along at least one side of the base and the label application surface.

15. The apparatus according to claim 14, further comprising:

a slit groove extending through the raised edge, wherein the object support element is disposed within the slit groove and movable therethrough;

a slide disposed within the slit groove; and a channel groove extending through the object support element, wherein the slide is disposed within the channel groove.

16. The apparatus according to claim 14, wherein the object support element comprises an arm connected to the raised edge and extending across from the label application surface, the arm laterally moveable over the label application surface.

17. The apparatus according to claim 16, further comprising:

a groove extending in a top side of the raised edge; and a slide disposed and moveable within the groove.

18. The apparatus according to claim 16, further comprising a second arm connected to at least one of the arm or at a second edge of the base and extending across and spaced apart from the label application surface.

19. The apparatus according to claim 10, further comprising a base, wherein each of the pair of first object alignment elements is part of or connected to the base, and each of the pair of first object alignment elements is movable over the base.

20. The apparatus according to claim 7, wherein the chute comprises surfaces in contact with four sides of the object upon the object placed down through the chute.

21. A method of applying a label to an object with the apparatus according to claim 7, comprising:

removing at least a portion of a back sheet from a label assembly to expose an adhesive material on at least a portion of a label of the label assembly;

framing at least a portion of the exposed adhesive with the first and second alignment elements that are disposed above the label assembly; and lowering or dropping the object onto the exposed adhesive material between the alignment elements.

* * * * *